US006678383B2

(12) United States Patent
Ito et al.

(10) Patent No.: US 6,678,383 B2
(45) Date of Patent: Jan. 13, 2004

(54) CAPACITOR MICROPHONE

(75) Inventors: Motoaki Ito, Shizuoka (JP); Yoshio Imahori, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 157 days.

(21) Appl. No.: 09/984,247

(22) Filed: Oct. 29, 2001

(65) Prior Publication Data

US 2002/0051547 A1 May 2, 2002

(30) Foreign Application Priority Data

Oct. 30, 2000 (JP) ..... P.2000-331188

(51) Int. Cl.[7] ..... H04R 25/00

(52) U.S. Cl. ..... 381/174; 381/191; 381/173; 381/113; 381/116; 29/25.41; 367/170; 367/181

(58) Field of Search ..... 381/174, 191, 381/113, 116, 173, 1; 367/170, 181; 29/25.41

(56) References Cited

U.S. PATENT DOCUMENTS 4,258,235 A * 3/1981 Watson
5,097,515 A * 3/1992 Baba
5,272,758 A * 12/1993 Isogami
6,111,966 A * 8/2000 Staat
6,166,580 A * 12/2000 Sessions
6,308,398 B1 * 10/2001 Beavers
6,512,833 B2 * 1/2003 Himori

* cited by examiner

*Primary Examiner*—Curtis Kuntz
*Assistant Examiner*—Dionne N. Harvey
(74) *Attorney, Agent, or Firm*—Sughrue Mion, PLLC

(57) ABSTRACT

A capacitor microphone includes a case having an end wall defining an opening for a sound hole, a capacitor portion comprising a diaphragm, a back plate and a spacer, the diaphragm opposing to the back plate via the spacer, the capacitor portion being accommodated in the case in such an manner as the diaphragm is placed on the side of the end wall, and a substrate accommodated in the case farther from the end wall than the capacitor portion, the substrate having an impedance conversion element mounted on a surface thereof facing the capacitor portion. A communicating opening is provided around the back plate in a position opposing to the impedance conversion element for communicating spaces on the front and back sides of the back plate. The communicating opening has a larger area than that of the top of the impedance conversion element to allow the spaces on both sides of the back plate to communicate with each other. It is possible to ensure that the impedance element and the back plate do not interfere with each other.

7 Claims, 7 Drawing Sheets

CAPACITOR MICROPHONE

BACKGROUND OF THE INVENTION

1. Field of the Invention

The present invention relates to an electret-type capacitor microphone, and more particularly to a structure of a thin electret-type capacitor microphone.

2. Description of the Related Art

Conventionally, an electret-type capacitor microphone is known as a type of microphone.

As disclosed in, for example, Japanese Utility Model Registration No. 2587682, this electret-type capacitor microphone is arranged such that a capacitor portion and a substrate are accommodated in a hollow cylindrical case whose one end has an end face wall defining an opening for a sound hole and whose other end is open. The capacitor portion is formed by a diaphragm and a back plate opposing to each other with a spacer placed therebetween and a substrate has an impedance conversion element (active element) mounted thereon for converting a change of the electrostatic capacity of the capacitor portion into electric impedance.

As disclosed in the aforementioned publication as well, the arrangement often adopted is such that the capacitor portion is accommodated with the diaphragm positioned on the one end side of the case, while the substrate is accommodated on the other end side of the case relative to the capacitor portion with the impedance conversion element facing the capacitor portion.

The electret-type capacitor microphone can be relatively easily constructed with a compact size. However, when the electret-type capacitor microphone is installed in a cellular phone or the like which tends to be increasingly thinner in recent years, it is desirable to not only make the capacitor microphone compact but also make as thin as possible.

However, with the above-described conventional electret-type capacitor microphone, an interval somewhat larger than the height of the impedance conversion element needs to be secured between the back plate and the substrate in order to prevent interference between the back plate of the capacitor portion and the impedance conversion element. For this reason, there is a problem in that the capacitor microphone cannot be made very thin, therefore making it impossible to cope with the demand for the thinner capacitor microphone in recent years.

SUMMARY OF THE INVENTION

The invention has been made in view of the above-described circumstances. An object of the present invention is to provide an electret-type capacitor microphone which can be made sufficiently thin.

In the present invention, the above object is attained by forming a predetermined communicating opening in the back plate.

According to the present invention, there is provided a capacitor microphone comprising:

a case having an end wall defining an opening for a sound hole;

a capacitor portion comprising a diaphragm, a back plate and a spacer, the diaphragm opposing to the back plate via the spacer, the capacitor portion being accommodated in the case in such an manner as the diaphragm is placed on the side of the end wall; and a substrate accommodated in the case farther from the end wall than the capacitor portion, the substrate having an impedance conversion element mounted on a surface thereof facing the capacitor portion, wherein a communicating opening is provided around the back plate in a position opposing to the impedance conversion element for communicating spaces on the front and back sides of the back plate; and the communicating opening has a larger area than that of the top of the impedance conversion element.

In the capacitor microphone, the top of the impedance conversion element is inserted into the communicating opening.

In the capacitor microphone, the back plate has a recessed outer peripheral surface, and the communicating opening is provided between the recessed outer peripheral surface of the back plate and the inner peripheral surface of the case.

In the capacitor microphone, at least one terminal pin is mounted on the substrate so that the head of the pin faces the capacitor portion, another communicating opening is provided around the back plate in a position opposing to the head of the pin for communicating spaces on the front and back sides of the back plate, and the communicating opening has a larger area than the head of the pin.

The above-described "capacitor microphone" may be a foil electret-type capacitor microphone in which the diaphragm functions as an electret, or may be a back electret-type capacitor microphone in which the back plate functions as an electret.

As for the "opening for a sound hole," insofar as it is an opening which functions as a tone hole, the opening itself may constitute the sound hole, or the sound hole may be formed by inserting and fitting a separate member in the opening.

As for the "impedance conversion element," insofar as it is capable of converting a change of the electrostatic capacity of the capacitor portion into electric impedance, the impedance conversion element is not limited to a particular element. For example, a junction field-effect transistor (JFET) or the like may be adopted.

As for the "communicating opening," insofar as it has an opening area larger than the area of the upper end portion of the impedance conversion element, its size, shape and the like are not particularly limited. The "communicating opening" may be provided in the back plate alone or may be formed in the back plate and another member.

According to the capacitor microphone according to the invention, the communicating opening having the opening area larger than the area of the upper end portion of the impedance conversion element to allow spaces on both sides of the back plate to communicate with each other is formed in the back plate at the position opposing the impedance conversion element. Accordingly, it is possible to ensure that the impedance conversion element and the back plate do not interfere with each other, even if an interval somewhat larger than the height of the impedance conversion element is not secured between the back plate and the substrate in the conventional manner.

Therefore, according to the invention, it is possible to make a thin capacitor microphone sufficiently.

It should be noted that, as also disclosed in the aforementioned publication, in a case where the diaphragm of the capacitor portion is positioned on the one end side of the case relative to the back plate, a measure is generally taken to expand the acoustic space inside the case by forming in the back plate a plurality of small holes for allowing the spaces on both sides of the back plate to communicate with each other. In the present invention, the aforementioned communicating opening can be made to function as the plurality of small holes.

In the above-described construction, if an arrangement is provided such that the upper end portion of the impedance conversion element is inserted in the communicating opening, the capacitor microphone can be made even thinner. This being the case, however, even if the distal end portion of the impedance conversion element is not inserted in the communicating opening, since the opening area of the communicating opening is larger than the area of the distal end portion of the impedance conversion element, the interval between the back plate and the substrate can be made narrower than in the conventional arrangement without causing interference between the impedance conversion element and the back plate.

As mentioned above, the specific arrangement of the aforementioned "communicating opening" is not particularly restricted, but if an arrangement is provided such that the communicating opening is formed between an inner peripheral surface of the case and an outer peripheral surface of the back plate formed in such a manner as to be indented toward an inner peripheral side thereof in relation to the inner peripheral surface, the communicating opening can be disposed at a position sufficiently spaced apart from the center of the diaphragm. Consequently, the capacitor microphone can be made thin without adversely affecting the acoustoelectric conversion characteristic of the capacitor microphone.

It should be noted that as the arrangement of a plurality of terminals provided in the capacitor microphone, some or all of the plurality of terminals may be constituted by terminal pins, and heads of the terminal pins may project toward the other end side of the case, and maybe fixed to the substrate. However, if this arrangement is adopted, there is a possibility of the terminal pins interfering with the back plate depending on the sizes of the heads of the terminal pins. Accordingly, if a communicating opening having an opening area larger than the area of the head of the terminal pin to allow the spaces on both sides of the back plate to communicate with each other is formed in the back plate at a position opposing the head of the terminal pin, it is possible to prevent the interference with the back plate.

This communicating opening for preventing the interference with the terminal pin maybe the same communicating opening as the communicating opening for preventing the interference with the impedance conversion element, or may be formed separately from it. Furthermore, in the case where there are a plurality of terminal pins, the communicating openings may be formed for the respective terminal pins, or a common communicating opening may be formed for some or all of the terminal pins.

It should be noted that, in this case as well, if the arrangement provided is such that the distal end portions of the heads of the terminal pins are inserted in the communicating openings, the capacitor microphone can be made thin even more easily.

DETAILED DESCRIPTION OF THE PRESENT INVENTION

Figure 1:
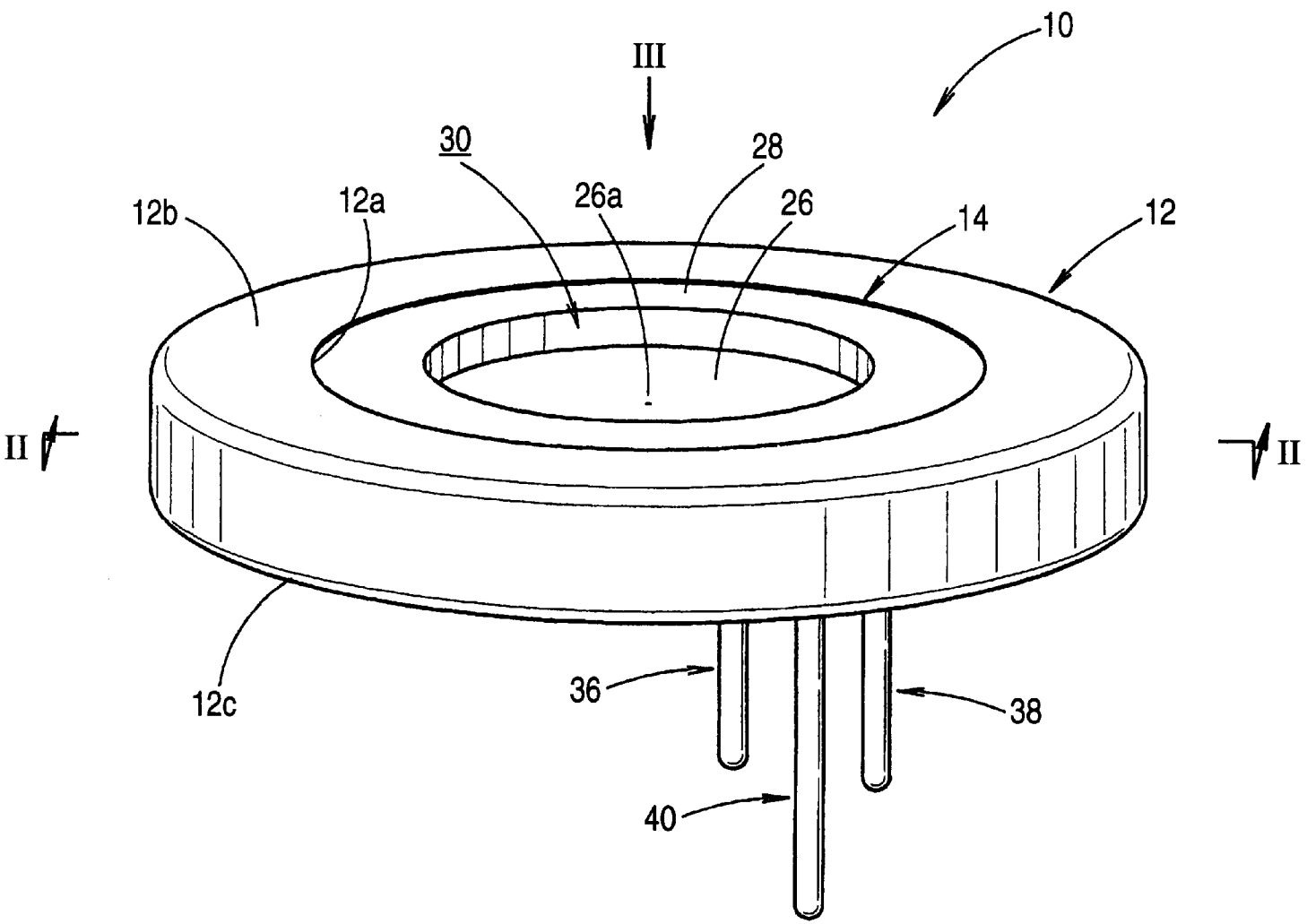
FIG. 1 is a perspective view showing a capacitor microphone disposed facing upward according to an embodiment of the invention.

Referring now to the drawings, the present invention will be described in detail with reference to the accompanying drawings.

Figure 2:
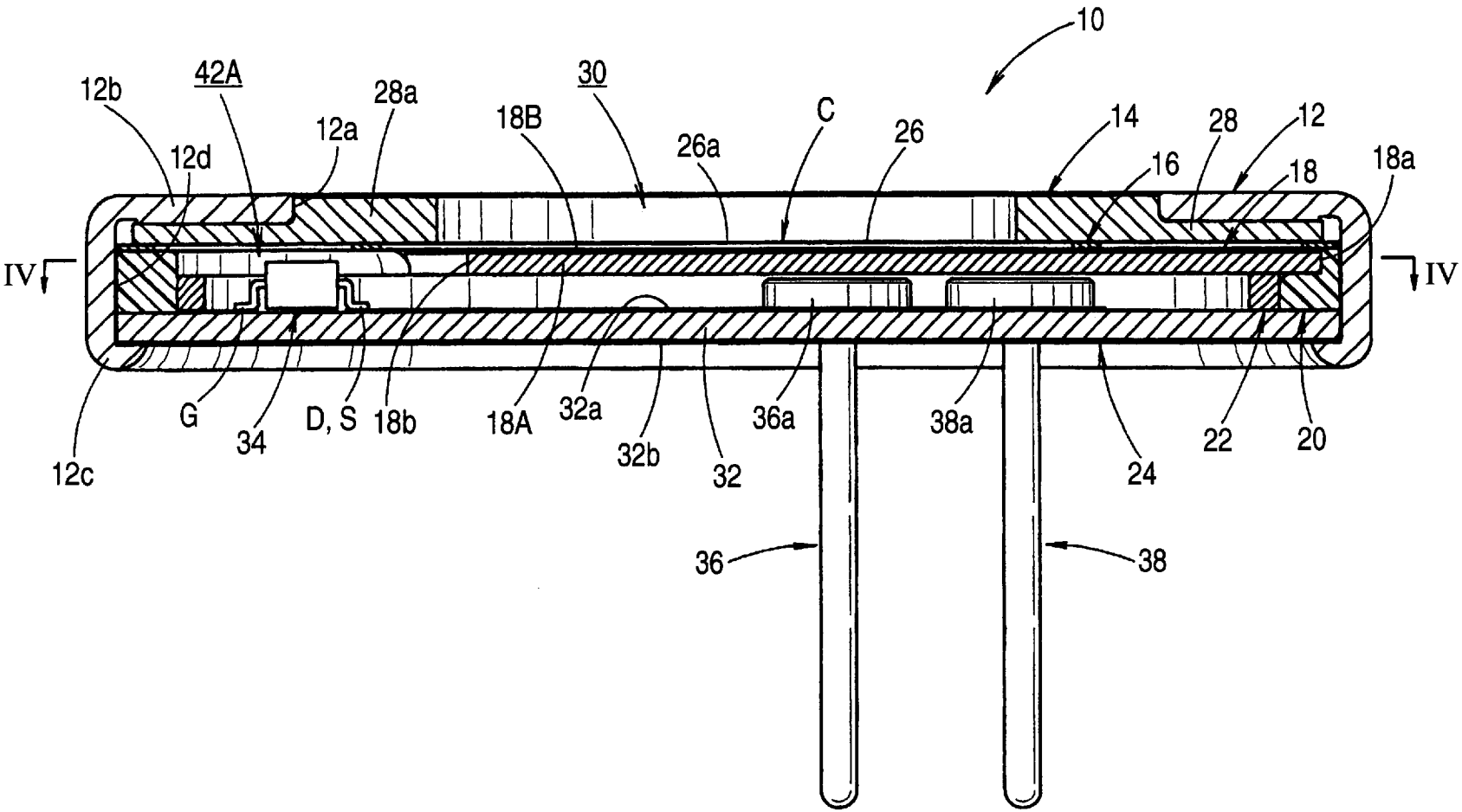
FIGS. 2 is a cross-sectional view taken along the line II—II in FIG. 1.
Figure 3:
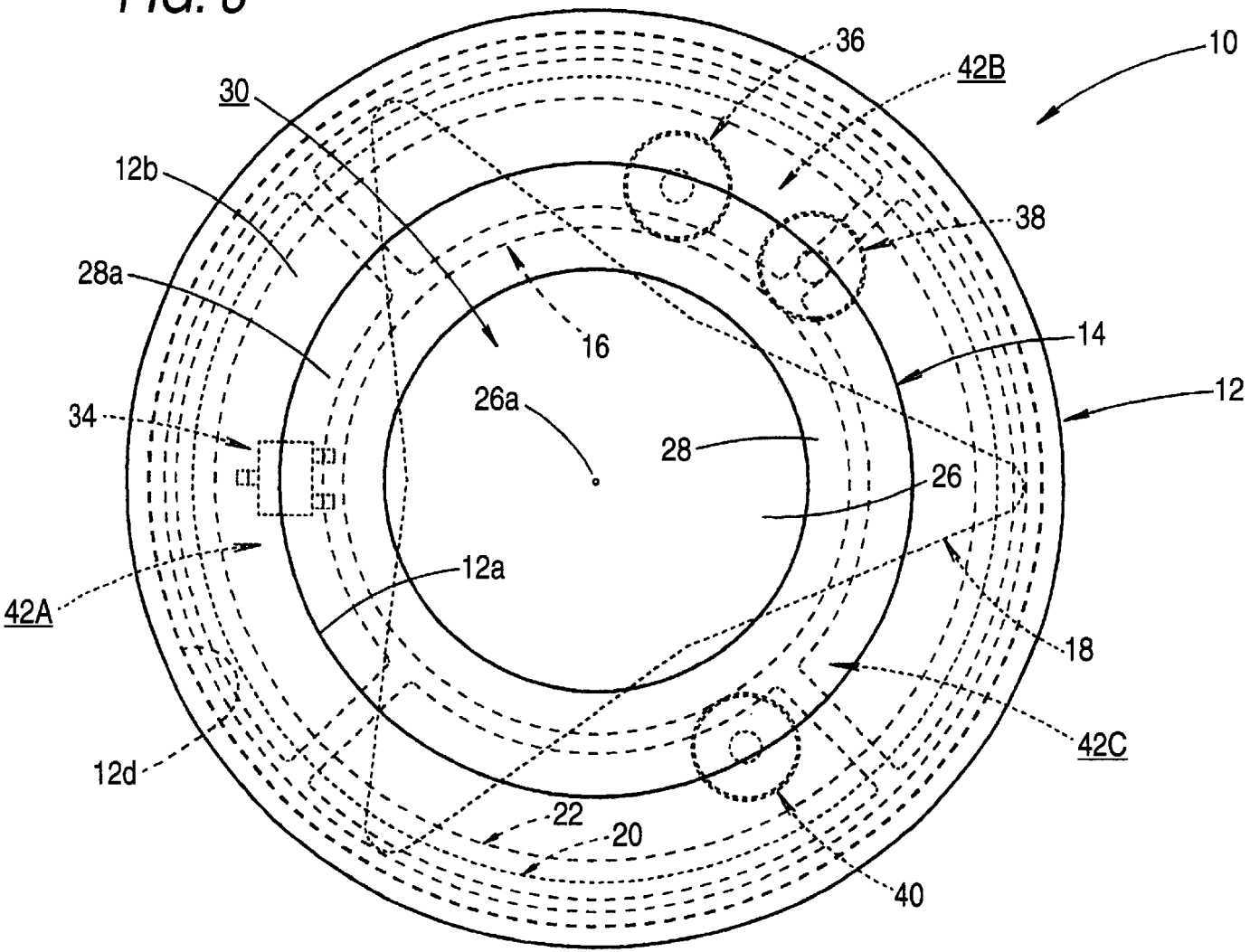
FIG. 3 is a view taken in the direction of the arrow III in FIG. 1.
Figure 4:
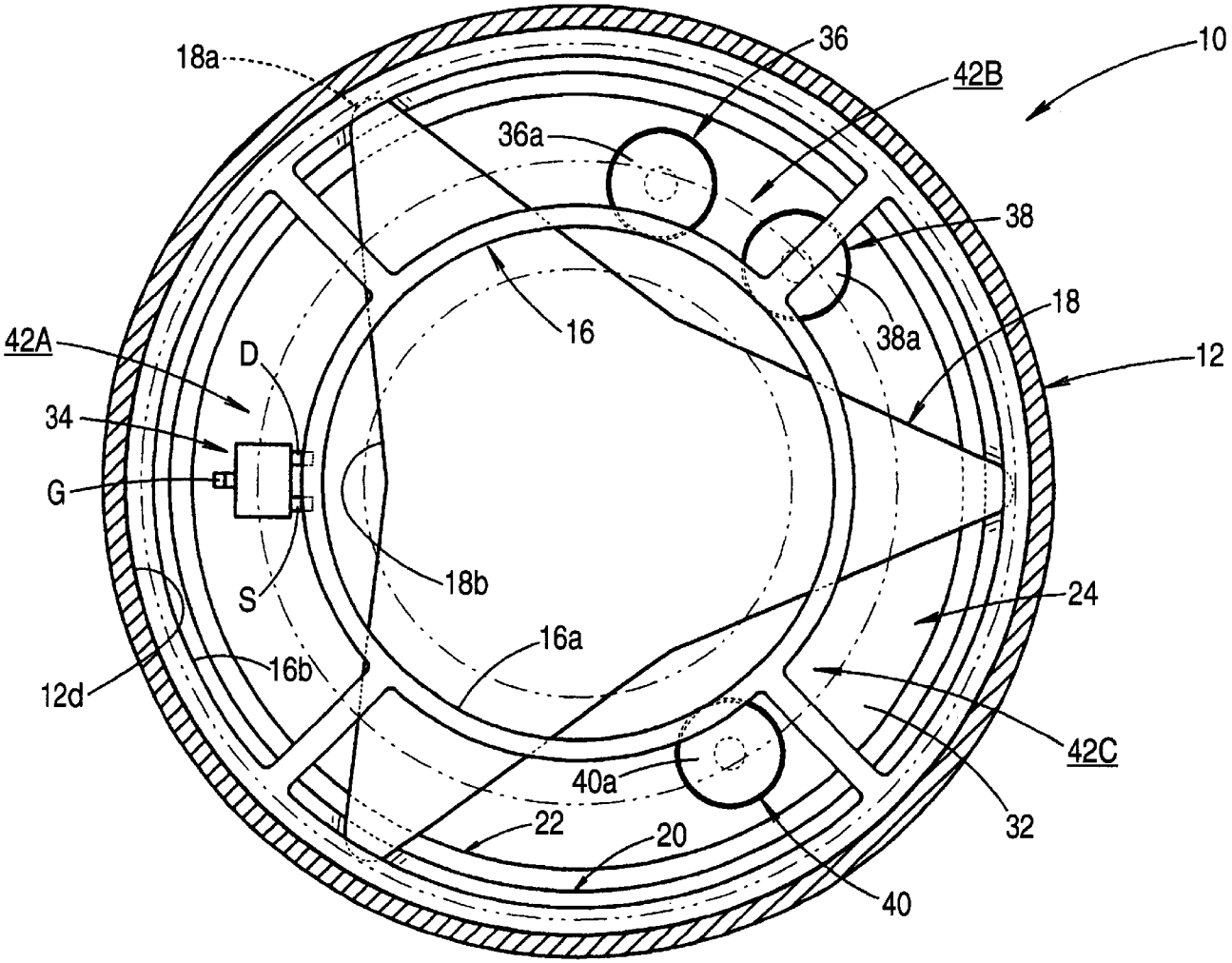
FIG. 4 is a cross-sectional view taken along the line IV—IV in FIG. 2.
Figure 5:
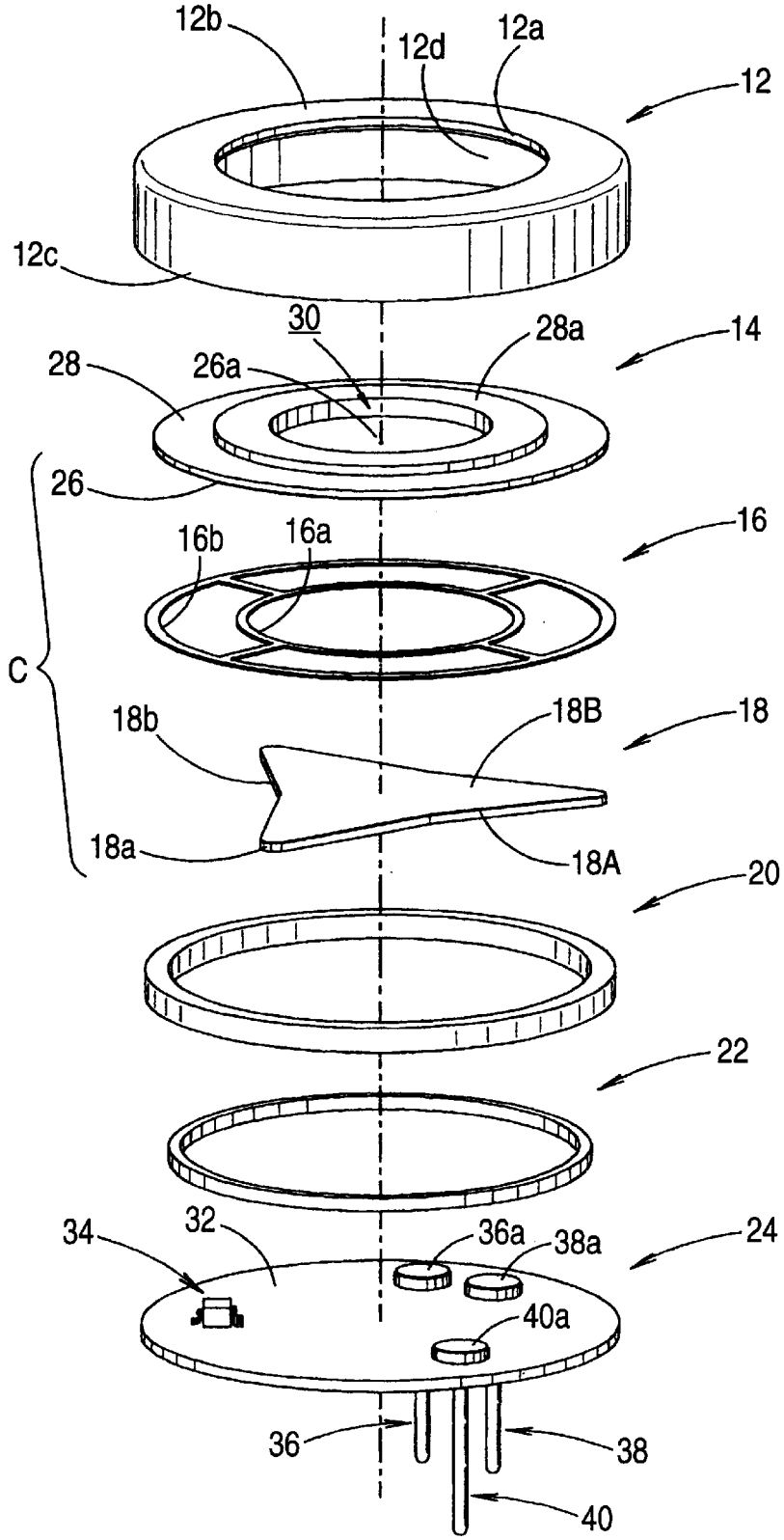
FIG. 5 is an exploded perspective view of the capacitor microphone.

FIG. 1 is a perspective view showing a capacitor microphone disposed facing upward according to an embodiment of the invention. FIG. 2 is a cross-sectional view taken along the line II—II in FIG. 1. FIG. 3 is a view taken in the direction of the arrow III in FIG. 1. FIG. 4 is a cross-sectional view taken along the line IV—IV in FIG. 2. FIG. 5 is an exploded perspective view of the capacitor microphone.

As shown in these drawings, a capacitor microphone 10 according to the invention is an electret-type compact microphone having an outside diameter of about 9 mm. Accommodated are a diaphragm subassembly 14, a spacer 16, a back plate 18, an insulating bush 20, an electrically conductive ring 22, and a junction field-effect transistor (JFET) board 24 (substrate) in the described order in a low-height hollow cylindrical case 12.

The case 12 is a metallic member, for example, made of aluminum, and formed by press forming or the like. The case 12 has an end face wall 12*b*, at the upper end (one end), defining an opening 12*a* for a sound hole having an inside diameter of about 6 mm. The lower end (the other end) of the case 12 is open. In a state in which the aforementioned parts are accommodated in the case 12, an open rim portion 12*c* of the case 12 is caulked and fixed to an outer peripheral edge of the JFET board 24.

Figure 6:
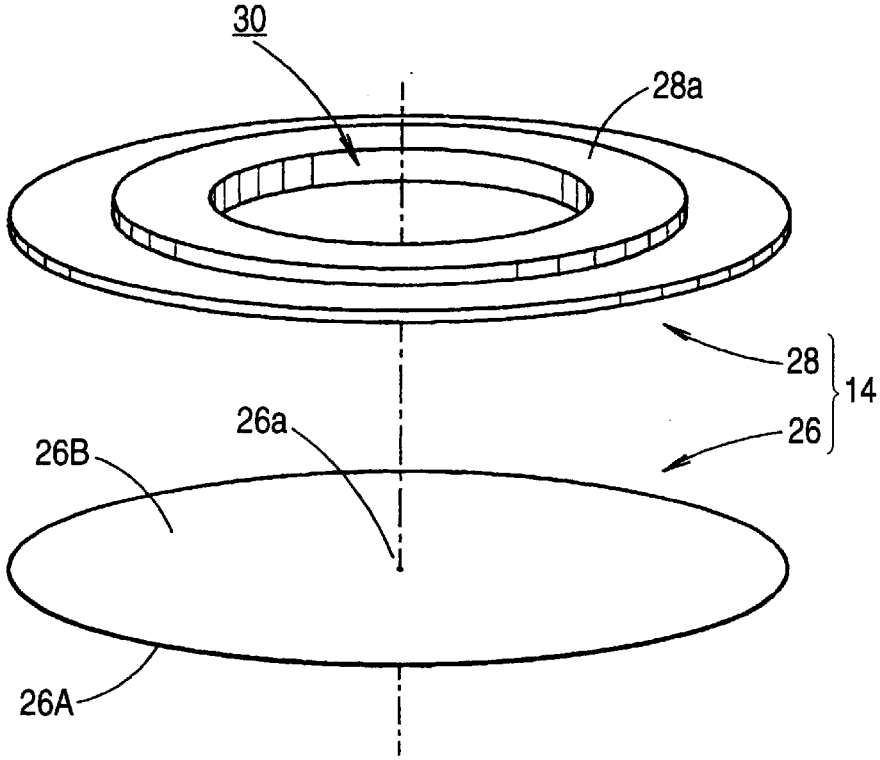
FIG. 6 is an exploded perspective view of a diaphragm subassembly of the capacitor microphone.

As shown in the exploded state in FIG. 6, the diaphragm subassembly 14 comprises a thin disk-shaped diaphragm 26 and an annular supporting frame 28 that fixes and supports the diaphragm 26. The upper surface of the diaphragm 26 is bonded and fixed onto a lower surface of the supporting frame 28, thereby electrically connecting the supporting frame 28 and the diaphragm 26. Further, a sound hole 30 is formed on the inner peripheral side of the supporting frame 28 in the diaphragm subassembly 14.

The diaphragm 26 is formed of a metal vapor-deposited film 26B of such as gold (Au) on an upper surface of a polyethylene terephthalate (PET) film 26A with a thickness of 1.5 $\mu$m or thereabouts. The outside diameter of the diaphragm 26 is set to a value (8.2 mm or thereabouts) slightly smaller than the inside diameter (8.5 mm or thereabouts) of the case 12. A vent hole 26*a* for adjusting the atmospheric pressure in and outside the capacitor microphone 10 is formed at the center of the diaphragm 26 in a penetrating manner. The inside diameter of the vent hole 26*a* is set to about 65 $\mu$m.

The supporting frame 28 is formed of a metal (e.g., phosphor bronze), and has an outside diameter substantially identical to that of the diaphragm 26 and an inside diameter of about 4 mm. A small-diameter annular projection 28*a* is integrally formed on the upper surface of the supporting frame 28. The outside diameter of the annular projection 28*a* is set to a value substantially identical to that of the opening 12*a* in the case 12. Consequently, when the diaphragm subassembly 14 is accommodated in the case 12, the annular projection 28*a* of the supporting frame 28 is fitted to the opening 12*a* in the end face wall 12*b* so as to effect the positioning of the two members. In the state in which the diaphragm subassembly 14 is accommodated in the case 12, the metal vapor-deposited film 26B of the diaphragm 26 is electrically connected to the case 12 through the supporting frame 28.

The spacer 16 is a frame-like member formed of a circular hard plate (e.g., a stainless steel plate) with a thickness of about 43 $\mu$m. The spacer 16 has an outside diameter substantially identical to the inside diameter of the case 12. The spacer 16 defines a large opening 16*a* and four large openings 16*b* respectively in a central portion and at the surrounding four positions of the circular hard plate.

Figure 7:
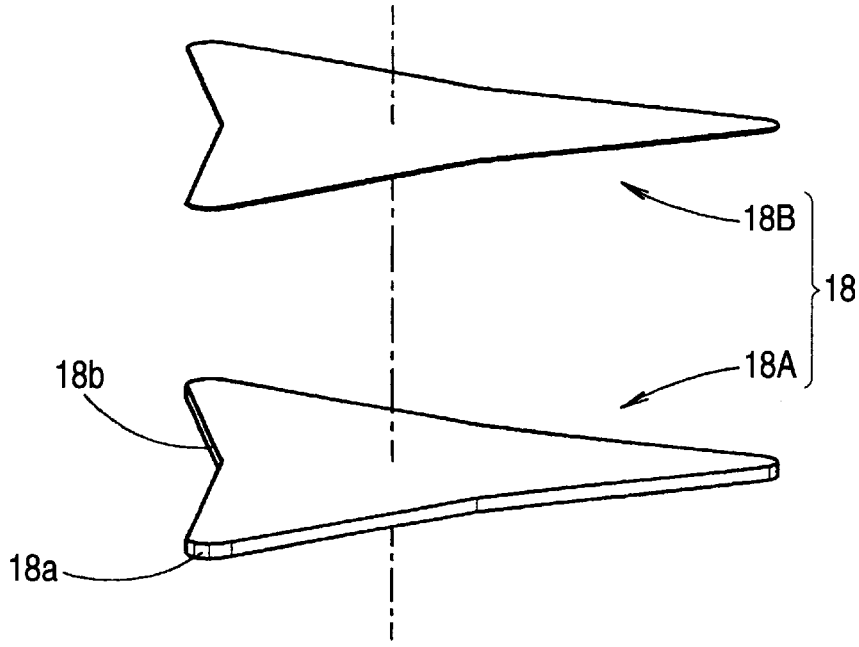
FIG. 7 is an exploded perspective view of a back plate of the capacitor microphone.

As shown in FIG. 7 in an exploded state, the back plate 19 comprises a back plate body 18A and an electret 18B formed on an upper surface of the back plate body 18A.

The back plate body 18A is formed of a metal plate (e.g., a stainless steel plate) with a thickness of about 0.16 mm. The outer shape of the back plate body 18A is formed into, so to speak, a star-shaped equilateral triangle in which the apexes of a regular triangle are rounded and the respective sides are bent toward the inner peripheral side. The electret 18B is formed of a fluorinated ethylene propylene (FEP) film with a thickness of 25 $\mu$m or thereabouts.

The back plate 18 is formed such that after the electret 18B is thermally fused (laminated) to the surface of the metal plate, the metal plate is punched out into a star-shaped regular triangle, and then the electret 18B is subjected to polarization treatment so as to set its surface potential to a predetermined level (e.g., −360V or thereabouts). The back plate 18 is adapted to be accommodated in the case 12 concentrically with the case 12. The size of the back plate 18 is set such that a predetermined gap (e.g., a gap of 0.1 mm or thereabouts) is formed between each of the three apexes 18*a* of the back plate 18 and an inner peripheral surface 12*d* of the case 12. In addition, bent points of the recessed three sides of the back plate 18 are set to be located innerly than the diameter of the sound hole 30.

Inside the case 12, the back plate 18 and the diaphragm 26 are opposed to each other with the spacer 16 placed therebetween, at an interval of about 43 $\mu$m which is the thickness of the spacer 16, thereby forming a capacitor portion C.

The insulating bush 20 is an annular member having an outside diameter substantially identical to the inside diameter of the case 12, and is formed of an elastic synthetic (e.g., polytetrafluoroethylene (PTFE)) or an elastomer. The thickness of the insulating bush 20 is set to a value slightly larger than the combined thickness of the back plate 18 and the conductive ring 22.

The conductive ring 22 is an annular member formed of a metal (e.g., stainless steel) and has an outside diameter substantially identical to the inside diameter of the insulating bush 20. The thickness of the conductive ring 22 is set to about 0.25 mm.

The JFET board 24 is formed such that a junction field-effect transistor (JFET) chip 34 and three terminal pins 36, 38, and 40 are mounted on a circular board body 32.

The board body 32 has an outside diameter substantially identical to the inside diameter of the case 12. Predetermined electrically conductive patterns 32*a* and 32*b* are respectively formed on the upper and lower surfaces of the board body 32.

The JFET chip 34 is an impedance conversion element for converting a change of the electrostatic capacity between the diaphragm 26 and the back plate 18 (i.e., the electrostatic capacity of the capacitor portion C) into electric impedance, and is mounted on the conductive pattern 32*a* formed on the upper surface of the board body 32.

The three terminal pins 36, 38, and 40 are fixed to the board body 32 such that their heads 36*a*, 38*a*, and 40*a* project on the board body 32. These three terminal pins 36, 38, and 40 are a power-supply terminal pin, output terminal pin, and grounding terminal pin, respectively. The power-supply terminal pin 36 and the output terminal pin 38 are respectively electrically connected to a drain electrode D and a source electrode S of the JFET chip 34 via the conductive pattern 32*a*. The grounding terminal pin 40 is electrically connected to the diaphragm 26 through the conductive pattern 32*b*, the case 12, and the supporting frame 28. Further, the gate electrode G of the JFET chip 34 is electrically connected to the back plate 18 through the conductive pattern 32*a* and the conductive ring 22.

The JFET chip 34 and the terminals pins 36, 38, and 40 are disposed at positions in the vicinity of an outer peripheral edge portion of the board body 32. As shown in FIG. 4, the JFET chip 34, the set of the power-supply terminal pin 36 and the output terminal pin 38, and the grounding terminal pin 40 are so arranged as to be located on substantially the same circumference substantially at 120° C. intervals with respect to each other in the circumferential direction of the board body 32.

Since the back plate 18 has the outer shape of a star-shaped equilateral triangle, three communicating openings 42A, 42B, and 42C are respectively formed between the three recessed sides of the star-shaped equilateral triangle and the inner peripheral surface 12*d* of the case 12 (exactly, the inner peripheral surface of the insulating bush 20). The communicating openings 42A, 42B and 42C allow space on the upper side of the back plate to communicate with space on the lower side thereof. These communicating openings 42A, 42B, and 42C are formed in the shape of flat fan-shaped openings and are formed in a relatively large size. Further, the communicating opening 42A is opposed to the JFET chip 34, the communicating opening 42B is opposed to the heads 36*a* and 38*a* of the power-supply terminal pin 36 and the output terminal pin 38, and the communicating opening 42C is opposed to the head 40*a* of the grounding terminal pin 40.

As shown in FIG. 2, the JFET chip 34 having relatively large height is set in such a state that the upper end portion (distal end portion) of the JFET chip 34 is inserted in the communicating opening 42A. On the other hand, the heads 36*a*, 38*a*, and 40*a* of the terminal pins 36, 38, and 40 having relatively small height are not inserted in the communicating openings 42B and 42C, but the upper end faces of the heads 36*a*, 38*a* and 40*a* are at a position slightly lower than the lower surface of the back plate 18.

Figure 8:
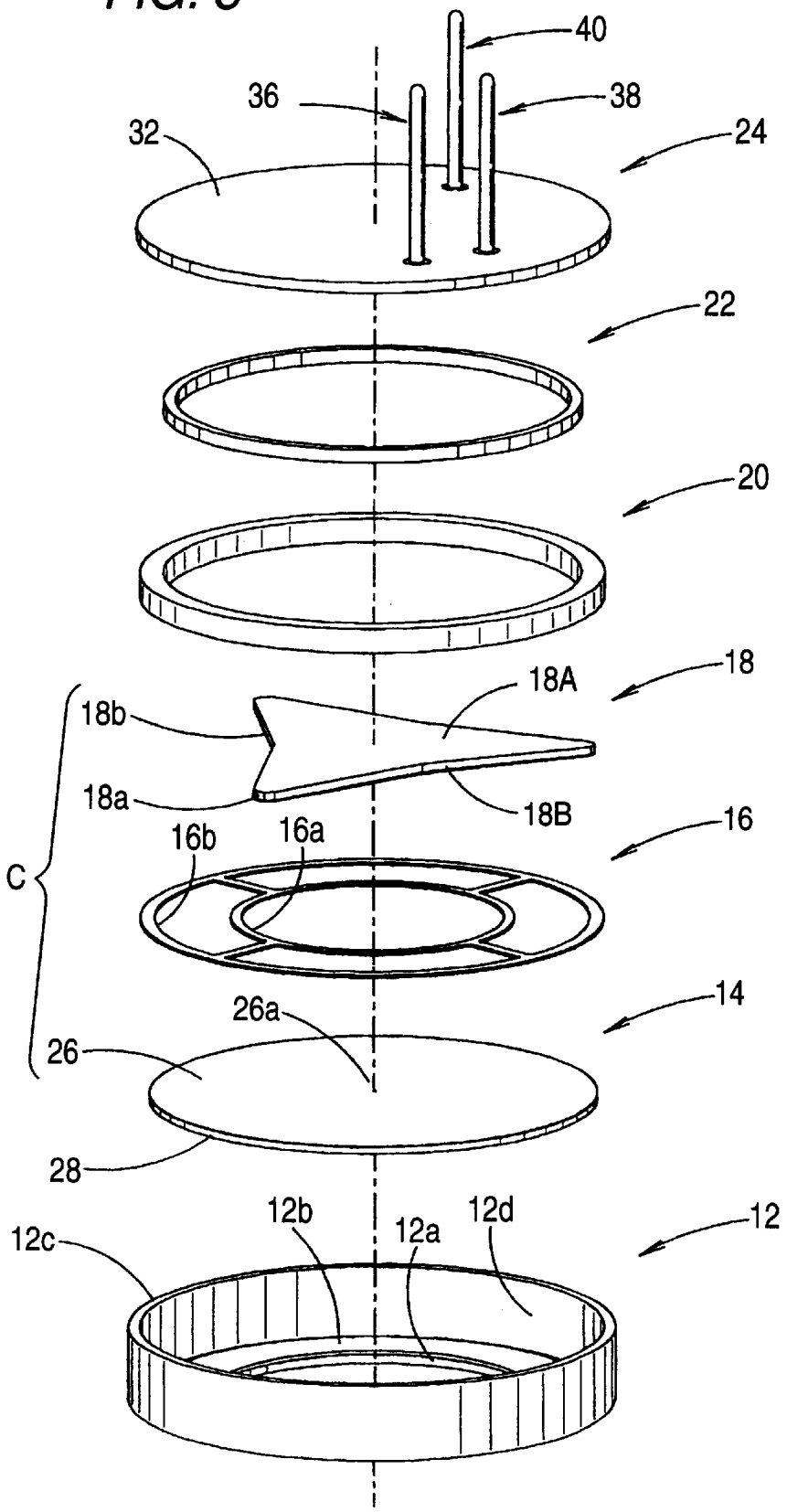
FIG. 8 is an exploded perspective view for explaining the method of assembling the capacitor microphone.

FIG. 8 is a perspective view for explaining the method of assembling the capacitor microphone 10 in accordance with this embodiment.

As shown, the capacitor microphone 10 is assembled such that the case 12 is disposed in a downwardly oriented manner (disposed so that the end face wall 12*b* is placed on the lower side), then the diaphragm subassembly 14, the spacer 16, the back plate 18, the insulating bush 20, the conductive ring 22, and the JFET board 24 are inserted from above in that order into the case 12, and then the open rim portion 12*c* of the case 12 is caulked.

First, the diaphragm subassembly 14 and the spacer 16 are consecutively inserted in the case 12. The diaphragm subassembly 14 is positioned with respect to the case 12 by fitting the annular projection 28*a* of the supporting frame 28 to the opening 12*a* for a sound hole in the case 12.

Next, the back plate 18, the insulating bush 20, and the conductive ring 22 are consecutively inserted into the case 12 by an automatic assembling machine. The center of the case 12 and the back plate 18 is respectively detected by an image recognition technique or the like. Then, the back plate 18 is inserted into the case 12 so that the centers thereof are aligned and the star-shaped equilateral triangle of the back plate 18 assumes a predetermined orientation. After the insertion of the back plate 18, the insulating bush 20 is inserted into the case 12 until it is brought into contact with the back plate 18, and the conductive ring 22 is inserted into the case 12 in such a manner as to be brought into internal contact with the insulating bush 20.

Subsequently, the JFET board 24 is inserted in the case 12 in such a manner that the JFET chip 34, the set of the power-supply terminal pin 36 and the output terminal pin 38, and the grounding terminal pin 40 are circumferentially positioned outward with respect to the bent points of the three recessed sides 18*b* of the back plate 18, respectively.

Finally, the open rim portion 12*c* of the case 12 is caulked and fixed to the outer peripheral edge portion of the board body 32 of the JFET board 24 over its entire circumference. This caulking and fixation is effected by pressuring the open rim portion 12*c* of the case 12 from above by an unillustrated caulking tool and bending the open rim portion 12*c* toward the inner peripheral side, and the pressurizing force at that time is also applied to the insulating bush 20 through the board body 32. Consequently, the insulating bush 20 undergoes elastic deformation and is further fitted into the gap between the inner peripheral surface 12*d* of the case 12 and each outer peripheral distal end face 18*a* of the back plate 18, thereby positioning the back plate 18 with respect to the case 12 in a state of being electrically insulated from the case 12. Furthermore, this also ensures the sealing characteristic between the case 12 and the JFET board 24, thereby enhancing the air-tightness of the space defined by the diaphragm subassembly 14 and the JFET board 24.

In the state in which the assembly of the capacitor microphone 10 has been completed, the interval between the back plate 18 and the board body 32 of the JFET board 24 is determined by the thickness of the conductive ring 22, and its value becomes 0.25 mm or thereabouts. In addition, the amount of elastic deformation of the insulating bush 20 is also determined by the thickness of the conductive ring 22.

As detailed above, the capacitor microphone 10 in accordance with this embodiment is arranged such that the capacitor portion C formed by the diaphragm 26 and the back plate 18 opposing each other with the spacer 16 placed therebetween is accommodated, with the diaphragm 26 being at the upper side, in the hollow cylindrical case 12 whose upper end has the opening 12*a* for a sound hole use and whose lower end is open. The JFET board 24 with the JFET chip 34 mounted thereon is accommodated, with its JFET chip 34 facing upward, on the lower side of the capacitor portion C. Since the communicating opening 42A having an opening area larger than the side of the upper end portion of the JFET chip 34 is formed around the back plate 18 at the position opposing the JFET chip 34, it is possible to ensure that the JFET chip 34 and the back plate 18 do not interfere with each other. Conventionally, a larger gap than the JFET chip 34 is needed between the back plate 18 and the JFET board 24 to prevent such interference.

Therefore, in accordance with this embodiment, it is possible to make the capacitor microphone sufficiently thin.

Moreover, in this embodiment, since the upper end portion of the JFET chip 34 is inserted in the communicating opening 42A, the capacitor microphone 10 can be made further thinner. Specifically, the overall height of the case 12 can be lowered to approximately 1.2 mm or less.

In this embodiment, since the communicating opening 42A is formed between the inner peripheral surface 12*d* of the case 12 and the recessed side 18*b* of the back plate 18, it is sufficiently spaced apart from the center of the diaphragm 26. Consequently, the capacitor microphone 10 can be made thin without adversely affecting the acoustoelectric conversion characteristic of the capacitor microphone 10.

The capacitor microphone 10 in accordance with this embodiment has the three terminal pins 36, 38, and 40, and their heads 36*a*, 38*a*, and 40*a* project on the board body 32. Through the upper end faces of the heads 36*a*, 38*a*, and 40*a* are only slightly lower than the lower surface of the back plate 18, there occurs no interference since the communicating opening 42B having a sufficiently large opening area is formed at the position opposing the heads 36*a* and 38*a*, and the communicating opening 42C having a sufficiently large opening area is formed at the position opposing the head 40*a*.

Furthermore, in this embodiment, the back plate 18 has the outer shape of a star-shaped equilateral triangle, and the JFET chip 34, the set of the power-supply terminal pin 36 and the output terminal pin 38, and the grounding terminal pin 40 are so provided as to be located on substantially the same circumference at intervals of approximately 120 degrees in the circumferential direction of the board body 32. Therefore, by simply rotating the back plate 18 and the JFET board 24 by a maximum of ⅓ revolution in the circumferential direction, the JFET chip 34, the set of the power-supply terminal pin 36 and the output terminal pin 38, and the grounding terminal pin 40 can be simultaneously positioned substantially at the centers of the three communicating openings 42A, 42B, and 42C, respectively.

It should be noted that although the capacitor microphone 10 in accordance with this embodiment is formed by caulking and fixing the open rim portion 12*c* of its case 12 to the outer peripheral edge portion of the board body 32 of the JFET board 24, an arrangement may be alternatively provided such that a fixing ring which is brought into contact with the board body 32 from below is press-fitted into the case 12, and this fixing ring is fixed to the case 12 by means of laser welding or the like.

What is claimed is:

1. A capacitor microphone comprising:

a case having an end wall defining an opening for a sound hole;

a capacitor portion comprising a diaphragm, a back plate and a spacer, the diaphragm opposing to the back plate via the spacer, the capacitor portion being accommodated in the case in such a manner as the diaphragm is placed on the side of the end wall; and a substrate accommodated in the case farther from the end wall than the capacitor portion, the substrate having an impedance conversion element mounted on a surface thereof facing the capacitor portion, wherein a communicating opening is provided around the back plate in a position opposing to the impedance conversion element for communicating spaces on the front and back sides of the back plate; and the communicating opening has a larger area than that of the top of the impedance conversion element; and wherein the top of the impedance conversion element is inserted into the communicating opening.

2. The capacitor microphone according to claim 1, wherein at least one terminal pin is mounted on the substrate so that a head of the pin faces the capacitor portion, another communicating opening is provided around the back plate in a position opposing to the head of the pin for communicating spaces on the front and back sides of the back plate, and the communicating opening has a larger area than the head of the pin.

3. The capacitor microphone according to claim 1, wherein the back plate has a recessed outer peripheral surface, and the communicating opening is provided between the recessed outer peripheral surface of the back plate and the inner peripheral surface of the case.

4. The capacitor microphone according to claim 3, wherein at least one terminal pin is mounted on the substrate so that a head of the pin faces the capacitor portion, another communicating opening is provided around the back plate in a position opposing to the head of the pin for communicating spaces on the front and back sides of the back plate, and the communicating opening has a larger area than the head of the pin.

5. A capacitor microphone comprising:

a case having an end wall defining an opening for a sound hole;

a capacitor portion comprising a diaphragm, a back plate and a spacer, the diaphragm opposing to the back plate via the spacer, the capacitor portion being accommodated in the case in such a manner as the diaphragm is placed on the side of the end wall; and a substrate accommodated in the case farther from the end wall than the capacitor portion, the substrate having an impedance conversion element mounted on a surface thereof facing the capacitor portion, wherein a communicating opening is provided around the back plate in a position opposing to the impedance conversion element for communicating spaces on the front and back sides of the back plate; and the communicating opening has a larger area than that of the top of the impedance conversion element; and wherein the back plate has a recessed outer peripheral surface, and the communicating opening is provided between the recessed outer peripheral surface of the back plate and the inner peripheral surface of the case.

6. The capacitor microphone according to claim 5, wherein at least one terminal pin is mounted on the substrate so that a head of the pin faces the capacitor portion, another communicating opening is provided around the back plate in a position opposing to the head of the pin for communicating spaces on the front and back sides of the back plate, and the communicating opening has a larger area than the head of the pin.

7. A capacitor microphone comprising:

a case having an end wall defining an opening for a sound hole;

a capacitor portion comprising a diaphragm, a back plate and a spacer, the diaphragm opposing to the back plate via the spacer, the capacitor portion being accommodated in the case in such a manner as the diaphragm is placed on the side of the end wall; and a substrate accommodated in the case farther from the end wall than the capacitor portion, the substrate having an impedance conversion element mounted on a surface thereof facing the capacitor portion, wherein a communicating opening is provided around the back plate in a position opposing to the impedance conversion element for communicating spaces on the front and back sides of the back plate;

the communicating opening has a larger area than that of the top of the impedance conversion element; and at least one terminal pin is mounted on the substrate so that a head of the pin faces the capacitor portion;

another communicating opening is provided around the back plate in a position opposing to the head of the pin for communicating spaces on the front and back sides of the back plate; and the communicating opening has a larger area than the head of the pin.

* * * * *